US007976692B2

(12) United States Patent
Hu et al.

(10) Patent No.: US 7,976,692 B2
(45) Date of Patent: Jul. 12, 2011

(54) METALLIZATION PROCESS FOR MAKING FUSER MEMBERS

(75) Inventors: Nan-Xing Hu, Oakville (CA); Yu Qi, Oakville (CA); Qi Zhang, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 441 days.

(21) Appl. No.: 12/179,992

(22) Filed: Jul. 25, 2008

(65) Prior Publication Data

US 2010/0021748 A1 Jan. 28, 2010

(51) Int. Cl.
*C23C 28/02* (2006.01)
*C23C 28/00* (2006.01)
*C25D 5/34* (2006.01)

(52) U.S. Cl. ..... 205/187; 205/196; 205/210

(58) Field of Classification Search ..... 205/187, 205/196, 210
See application file for complete search history.

(56) References Cited

U.S. PATENT DOCUMENTS

| | | | | |
|---|---|---|---|---|
| 5,501,881 | A | 3/1996 | Fuller et al. | |
| 5,512,409 | A | 4/1996 | Henry et al. | |
| 5,729,813 | A | 3/1998 | Eddy et al. | |
| 7,054,589 | B2 | 5/2006 | Okayasu et al. | |
| 7,336,919 | B2 * | 2/2008 | Beach et al. | 399/333 |
| 2006/0067754 | A1 * | 3/2006 | Gilmore et al. | 399/333 |
| 2007/0172643 | A1 * | 7/2007 | Krawczyk | 428/323 |
| 2008/0149566 | A1 * | 6/2008 | Messersmith et al. | 210/702 |

FOREIGN PATENT DOCUMENTS

| | | | |
|---|---|---|---|
| FR | 2045398 A | * | 2/1971 |
| JP | 2004070155 A | * | 3/2004 |

OTHER PUBLICATIONS

Morita et al., "Selective Electrochemical Detection of Catechol and Catecholamines on Modified Electrodes with Molecular Template", Denko Kagaku Oyobi Kogyo Butsuri Kagaku (no month, 1996), vol. 64 , No. 12, pp. 1239-1243. Abstract Only.*

Science, Mussel-Inspired Surface Chemistry for Multifunctional Coatings, Haeshin Lee, et al., vol. 318, No. 426, Oct. 19, 2007, pp. 426-430.

* cited by examiner

*Primary Examiner* — Edna Wong

(74) *Attorney, Agent, or Firm* — Pillsbury Winthrop Shaw Pittman LLP

(57) ABSTRACT

The presently disclosed embodiments are directed to an improved metallization process for making fuser members which avoids the extra steps of metal seeding or special substrate treatment. In embodiments, a metallized substrate, formed via a polycatecholamine-assisted metallization process, is used for the complete fabrication of the fuser member.

15 Claims, No Drawings

METALLIZATION PROCESS FOR MAKING FUSER MEMBERS

BACKGROUND

The presently disclosed embodiments relate generally to layers that are useful in imaging apparatus members and components, for use in electrophotographic, including digital, apparatuses. More particularly, the embodiments pertain to an improved metallization process for making fuser members, such as for example, inductively heated fuser rolls or belts. In embodiments, a metallized substrate, formed via a polycatecholamine-assisted metallization process, is used for the complete fabrication of the fuser member.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members. The visible toner image thus transferred on the print substrate, which is in a loose powdered form and can be easily disturbed or destroyed, is usually fixed or fused to form permanent images. The use of thermal energy for fixing toner images onto a support member is well known. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Several approaches to thermal fusing of electroscopic toner images have been described in the prior art. These methods include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time is provided. The balancing of these parameters to bring about the fusing of the toner particles is well known in the art, and they can be adjusted to suit particular machines or process conditions.

Fuser and fixing rolls or belts may be prepared by applying one or more layers to a suitable substrate. Typically, fuser and fixing rolls or belts comprises a surface layer for good toner releasing. Cylindrical fuser and fixer rolls, for example, may be prepared by applying an silicone elastomer or fluoroelastomer to serve as a releasing layer. The coated roll is heated to cure the elastomer. Such processing is disclosed, for example, in U.S. Pat. Nos. 5,501,881; 5,512,409; and 5,729,813; the disclosure of each of which is incorporated by reference herein in their entirety. Known fuser surface coatings also include crosslinked fluoropolymers such as VITON-GF® (DuPont) used in conjunction with a release fluid, or fluororesin such as polytetrafluoroethylene (hereinafter referred to as "PTFE"), perfluoroalkylvinylether copolymer (hereinafter referred to as "PFA") and the like.

A heating member is typically provided for thermal fusing of electroscopic toner images. Several heating methods have been described for toner fusing in the prior art. In order to shorten the warm up time, the time required heating the fuser or fixing member to the fusing temperature, induction heating technique has been applied for toner fusing. An image fusing or fixing apparatus utilizing induction heating generally comprises a fusing member such as a roll or belt, an electromagnet component comprised of, for instance, a coil, which is electrically connected to a high-frequency power supplier. The coil is arranged at a position inside the fusing member or outside and near the fusing member. The fusing member suitable for induction heating comprises a metal heating layer. When a high-frequency alternating current provided by the power supplier is passed through the coil, an eddy current is induced within the heating metal of the fusing member to generate thermal energy by resistance to heat the fusing member to the desired temperature.

For example, U.S. Pat. No. 7,054,589, discloses an image fixing belt suitable for induction heating and a method of manufacturing the same, which is hereby incorporated by reference.

In the context of electrophotographic fusing members, the key components include a fuser belt with a multi-layer configuration comprised of, for example, a polyimide substrate, deposited on the substrate, a metal layer comprised of nickel or copper, an optional elastic layer comprised of an elastomer, and an outmost releasing layer.

In a conventional manner, electroless plating method is used deposit a thin metal layer on the substrate to provide electrically conductive surface. A subsequent electroplating process is then applied to form a uniform copper/nickel layer. Conventionally, several steps are required prior to the electroless plating step, including palladium seeding and substrate surface pretreatment. The need for seeding or special modification of the substrate surfaces involved with conventional electroless techniques are some of the key technical challenges for making the fusing belts in order to produce an uniform metal coating.

Thus, it is desired to devise a more simple and efficient manner of electroless plating technique for use in making fuser members, for example, fuser belts.

SUMMARY

According to aspects illustrated herein, there is provided a process for forming a fuser member, comprising providing a substrate, treating the substrate with a catecholamine coating solution to form a polycatecholamine layer, electroless plating a thin metallized layer on the polycatecholamine layer by immersing the treated substrate into an electroless metal plating solution, and electroplating the pre-metallized substrate in a metal plating solution to form a uniform metal layer on the thin metallized layer.

A further embodiment provides a process for forming a fuser member, comprising providing a polyimide substrate, treating the polyimide substrate with a polymer solution comprising a dopamine compound and an aminosilane coupling agent, to form a polydopamine layer, immersing the treated substrate into an electroless metal plating solution to form a thin metallized layer on the polydopamine layer, and electroplating the substrate to form a uniform metal layer on the thin metallized layer.

In yet another embodiment, there is provided an induction heating fuser member comprising a polyimide substrate, a metal heating layer over the polyimide substrate, an elastic layer over the metal heating layer, and an outmost releasing layer over the elastic layer, wherein the metal heating layer is made by the process described above.

DETAILED DESCRIPTION

In the following description, there is illustrated several embodiments. It is understood that other embodiments may be utilized and structural and operational changes may be made without departure from the scope of the present disclosure.

In a typical electrophotographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, the photoreceptor is charged on its surface by means of an electrical charger to which a voltage has been supplied from power supply. The photoreceptor is then imagewise exposed to light from an optical system or an image input apparatus, such as a laser and light emitting diode, to form an electrostatic latent image thereon. Generally, the electrostatic latent image is developed by bringing a developer mixture from developer station into contact therewith. Development can be effected by use of a magnetic brush, powder cloud, or other known development process.

After the toner particles have been deposited on the photoconductive surface, in image configuration, they are transferred to a copy sheet by transfer means, which can be pressure transfer or electrostatic transfer. In embodiments, the developed image can be transferred to an intermediate transfer member and subsequently transferred to a copy sheet.

After the transfer of the developed image is completed, the copy sheet advances to a fusing station, wherein the developed image is fused to the copy sheet by passing copy sheet the between the fusing member and pressure member, thereby forming a permanent image. Fusing may be accomplished by the application of heat and pressure substantially concurrently by various means: a roll pair maintained in pressure contact; a belt member in pressure contact with a roll; and the like.

In an image fusing system with fast warm up time, an image fusing or fixing apparatus generally comprises a fusing member such as a roll or belt, and an electromagnet component comprised of, for instance, a coil, which is electrically connected to a high-frequency power supplier. The coil is arranged at a position inside the fusing member or outside and near the fusing member. The fusing member suitable for induction heating comprises a metal heating layer. When a high-frequency alternating current provided by the power supplier is passed through the coil, an eddy current is induced within the heating metal of the fusing member to generate thermal energy by resistance to heat the fusing member to the desired temperature. Image fusing members suitable for induction heating are known in the art, and may include a fuser belt with a multi-layer configuration comprised of, for example, a polyimide substrate, deposited on the substrate, a metal layer comprised of nickel or copper, an optional elastic layer comprised of an elastomer, and an outmost releasing layer. The fusing member may further comprise other layers in between the substrate and the metal heating layer, between the metal heating layer and the elastic layer, or between the elastic layer and the releasing layer, for adhesion or other property improvements.

Substrate

The substrate of the fusing member is not limited, as long as it can provide high strength and physical properties that do not degrade at a fusing temperature. Specifically, the substrate is made from a heat-resistant resin. Examples of the heat-resistant resin include resins having high heat resistance and high strength such as a polyimide, an aromatic polyimide, and a liquid crystal material such as a thermotropic liquid crystal polymer and the like, and the polyimide is most preferable among them. The thickness of the substrate falls within a range where rigidity and flexibility enabling the fusing belt to be repeatedly turned can be compatibly established, for instance, ranging from about 10 to about 200 micrometers or from about 30 to about 100 micrometers.

Metal Heating Layer

The metal heating layer is usually a thin metal film layer and is a layer that generates an eddy current under a magnetic field generated by a coil to thereby produce heat in the electromagnetic induction fusing apparatus, hereby metal producing an electromagnetic induction effect may be used for the metal heating layer. Such a metal can be selected from, for example, nickel, iron, copper, gold, silver, aluminum, steel, chromium and the like. Suitable thickness of the metal heating layer varies depending on the type of the metal used. For example, when copper is used for the metal heating layer, the thickness thereof ranges from 3 to 100 micrometers or from 5 to 50 micrometers.

Releasing Layer

The releasing layer of the fusing members is typically comprised of a fluorine-containing polymer to avoid toner stain. The thickness of such a releasing layer is ranging from about 3 micrometers to about 100 micrometers, or from about 5 micrometers to about 50 micrometers. Suitable fluorine-containing polymers may include fluoropolymers comprising a monomeric repeat unit that is selected from the group consisting of vinylidene fluoride, hexafluoropropylene, tetrafluoroethylene, perfluoroalkylvinylether, and mixtures thereof. The fluoropolymers may include linear or branched polymers, and cross-linked fluoroelastomers. Examples of fluoropolymer include a poly(vinylidene fluoride), or a copolymer of vinylidene fluoride with another monomer selected from the group consisting of hexafluoropropylene, tetrafluoroethylene, and a mixture thereof.

Specifically, fluoropolymers herein include the Viton® fluoropolymers from E. I. du Pont de Nemours, Inc. Viton® fluoropolymers include for example: Viton®-A, copolymers of hexafluoropropylene (HFP) and vinylidene fluoride (VDF or VF2), Viton®-B, terpolymers of tetrafluoroethylene (TFE), vinylidene fluoride (VDF) and hexafluoropropylene (HFP); and Viton®GF, tetrapolymers composed of TFE, VF2, HFP, and small amounts of a cure site monomer. Further examples of fluoropolymers include polytetrafluoroethylene (PTFE), perfluoroalkylvinylether copolymer (PFA), tetrafluoroethylene-hexafluoropropylene copolymer (FEP) and the like.

In embodiments, there is provided herein an improved method for forming the metal heating layer of a fusing member. The method described herein offer advantages such as avoiding use of expensive palladium catalyst as in conventional metallization on non-conductive substrate. Inspired by the composition of adhesive proteins produced by mussels, a group of scientists recently reported dopamine self-polymerization to form thin, surface-adherent polydopamine films onto specific materials, including various polymers (H. Lee et al. Science, 318, pp. 426-430 (2007), hereby incorporated by reference in its entirety). It was also taught that the polydopamine films may serve as a building layer for electroless metal plating. However, polydopamine films thus formed has poor adhesion to certain polymer substrate. Further, it may degrade when used in contact with acidic electroless metal solutions.

According to the present embodiments, there is provided a process that is used for forming a fuser member. The process uses a catecholamine coating solution to form a polycatecholamine layer on a substrate, and then uses electroless plating to make a thin metallized layer on the polycatecholamine layer by immersing the treated substrate into an electroless metal plating solution. The electroless metal plating solution may include, for example, nickel, copper, or silver. The pre-metallized substrate is subsequently used for complete fabrication of a fuser belt by electroplating the pre-metallized substrate in a metal plating solution to form a uniform metal layer on the thin metallized layer. The thickness of the thin metallized layer may range from about 5 nanometers to about 3000 nanometers, or from about 10 nanometers to about 1000 nanometers. In certain embodiments, the electroless plating may be repeated to form a thin metallized layer comprising a first metal, such as silver, and a second metal, such as copper or nickel.

In embodiments, the catecholamine described herein comprises a catechol compound containing an amino group, such as dopamine. Other types of catecholamine may also be used in accordance with the present embodiments, including but not limited to, dopamine, norepinephrine, dihydroxyphenylalanine, polydopamine, and mixtures thereof.

The electroless plating process disclosed herein offers several advantages as compared to conventional methods, including that no palladium catalyst seeding or need for special substrate treatment is required. Seeding with palladium is generally used and, as palladium is expensive and has a short shelf-life, it is a costly step that can be avoided with the present embodiments.

The polycatecholamine coating prepares the substrate for deposition of a metal layer, e.g., nickel layer, on the polyimide substrate by electroless plating. In embodiments, the substrate may comprise a polymer selected from the group consisting of a polyimide, an aromatic polyimide, polyether imide, polyphthalamide, and polyester. In a specific embodiment, the polyimide substrate is first treated, for example via dip-coating or spraying, with a catecholamine coating solution to form a polycatecholamine layer. The polycatecholamine coating solution may have a pH value of from about 2 to about 10, or from about 5 to about 8. The polycatecholamine-coated substrate is then immersed into an electroless metal plating solution to form a pre-metallized substrate ready to receive the uniform metal layers. Subsequently, the process is completed by depositing the copper/nickel layers onto the pre-metallized substrate by conventional electroplating techniques to form a thicker metal layer. The uniform metal layer may have a thickness of from about 3 micrometers to about 100 micrometers or from about 5 micrometers to about 80 micrometers. In embodiments, the plating solution for electroplating comprises a platable metal selected from the group consisting of copper, nickel and cobalt. The remaining silicone and PFA coatings are applied over the copper/nickel layers by also using existing conventional processes.

In present embodiments, the polycatecholamine layer may comprise a polymer product obtained from copolymerization of the catecholamine and an aminosilane coupling agent. For example, the catecholamine coating solution may further comprise a crosslinking agent, such as an aminosilane polymer. In embodiments, the catecholamine coating solution may comprise a mixture selected from the group consisting of a catecholamine compound, such as dopamine and the polymers thereof, an amino compound such as an aminosilane and its hydrolytic products such as polyaminosilane, the copolymers of a catecholamine and an aminosilane, and the mixtures thereof. Because catecholamines, such as dopamine, disintegrate in acidic conditions, the polycatecholamine layer formed dissolves in the subsequent electroless plating step. In order to avoid this problem and still be able to retain the benefits of the catecholamine coating solution, the present embodiments include a crosslinking agent, such as an aminosilane coupling agent. For example, the aminosilane coupling agent may be selected from an aminosilane compound represented by the following formula:

$$(R)_n Si(X)_{4-n}$$

and polymers formed from thereof, wherein n is an integer of 2 or 3; X is a hydrolytic group selected from the group consisting of a hydroxyl, an acetoxyl, an alkoxyl having from 1 to about 6 carbons, and mixtures thereof; and R is an organic group selected from the group consisting of an alkyl having from 1 to about 18 carbons, an aminoalkyl group having from 1 to about 18 carbons, a aryl having from 6 to about 30 carbons, an alkoxyl having from 1 to about 18 carbons, and mixtures thereof. In further embodiments, the aminosilane coupling agent is selected from the group consisting of 3-aminopropyltrialkoxysilane, 3-aminopropyldialkoxymethylsilane, aminoethylaminopropyltrialkoxysilane, and mixtures thereof, wherein the alkoxy is selected from the group consisting of methoxy, ethoxy, propoxy, and the like.

By including such an agent in the coating solution, the polycatecholamine forms a strong crosslinked layer that possesses improved adhesion and can withstand the acidic conditions of the subsequent electroless plating step. In addition, the coating solution may also include an adhesion promoter to further facilitate the formation of the thin metallized layer on the substrate.

Any suitable conventional electroless plating solutions may be utilized for the electroless metal plating steps. In certain embodiments, the electroless plating solution comprises a metal, such as silver, copper, or nickel. In further embodiments, the electroless plating solution may include a reducing agent, such as hypophosphite, a hydrazine compound, an aldehyde compound, hydrogen borate, hydroxylamine, a boran compound, and the like.

Any suitable conventional electroplating techniques may be utilized for the electroplating steps. In certain embodiments, the electroplating solution for electroplating comprises a platable metal selected from the group consisting of copper, nickel, and cobalt, chromium, and the like.

In a specific embodiment, further layers are formed over the uniform metal layer. For example, the process may further include depositing, in sequence, a first adhesive layer over the uniform metal layer, an elastic layer comprised of a silicone polymer over the adhesive layer, a second adhesive layer over the elastic layer, and an outmost releasing layer comprised of a fluoropolymer over the second adhesive layer. The fluoropolymer comprises a monomeric repeat unit that may be selected from the group consisting of vinylidene fluoride, hexafluoropropylene, tetrafluoroethylene, perfluoroalkylvinylether, and mixtures thereof.

In further embodiments, there is provided a fuser member, such as a fuser belt, made from the processes described above. In a particular embodiment, the fuser belt made from the processes above is an induction heating fuser member. In this embodiment, the induction heating fuser member comprises a polyimide substrate, a metal heating layer over the polyimide substrate, an elastic layer over the metal heating layer, and an outmost releasing layer over the elastic layer, wherein the metal heating layer is made in accordance with the processes described above. The present embodiments will be useful in induction heating fuser belts as the electromagnetic induction heating unit will not require contact with the fuser belt to function as intended. The current can be sensed by the metal layer in the induction heating fuser belt so that the heat is generated accordingly. In addition, the present embodiments also provide for an electrophotographic imaging apparatus comprising the fuser member.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

A polyimide substrate (Kapton® film from DuPont Chemical Co. (Wilmington, Del.) was used) was cleaned by dipping in the detergent solution for 5 minutes at room temperature, rinsing with distilled water, followed by air drying. The clean polyimide substrate was then dipped in the dopamine solution (0.012 M dopamine in a buffer solution of pH 8.5) while stirring for 3 hours. The substrate was rinse with distilled water and dried in Argon gas.

The polydopamine-coated substrate was metallized through immersion in electroless copper plating bath for 1 hour at 30° C. The bath solution was prepared by mixing 0.05 M ethylenediaminetetraacetic acid (EDTA), 0.05 M copper (II) chloride ($CuCl_2$), and 0.1 M boric acid, adjusting the pH to 7.0 using 1N NaOH, followed by adding 0.1 M dimethylamine-borane. The resulting Cu-deposited substrate was rinsed with distilled water and dried in Argon gas. A copper layer with about 10 μm was obtained by electroplating process using an electrolytic copper plating bath (Bright Acid Copper Bath from Caswell Inc., Lyons, N.Y.).

The remaining silicone and PFA coatings can be applied over the copper layer by using existing conventional processes.

Example 2

A double metal layer coated polyimide substrate containing copper and nickel layers were prepared by plating a 10 μm nickel layer on the copper-coated polyimide substrate prepared from Example 1. The nickel layer was obtained by conventional electroplating process using an electrolytic nickel plating bath (Bright Nickel Bath from Caswell Inc., Lyons, N.Y.).

The remaining silicone and PFA coatings are likewise applied over the nickel layer by using existing conventional processes.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for forming a fuser member, comprising:

providing a substrate, wherein the substrate is a heat-resistant resin;

treating the substrate with a catecholamine coating solution to form a polycatecholamine layer;

electroless plating a thin metallized layer on the polycatecholamine layer by immersing the treated substrate into an electroless metal plating solution, wherein the polycatecholamine layer comprises a polymer product obtained from copolymerization of the catecholamine and an aminosilane coupling agent; and electroplating the pre-metallized substrate in a metal plating solution to form a uniform metal layer on the thin metallized layer.

2. The process of claim 1, wherein the catecholamine is selected from the group consisting of dopamine, norepinephrine, dihydroxyphenylalanine, polydopamine, and mixtures thereof.

3. The process of claim 1, wherein the aminosilane coupling agent is selected from the group consisting of 3-aminopropyltrialkoxysilane, 3-aminopropyldialkoxymethylsilane, aminoethylaminopropyltrialkoxysilane, and mixtures thereof, wherein the alkoxy is selected from the group consisting of methoxy, ethoxy, and propoxy.

4. The process of claim 1, wherein the catecholamine coating solution possesses a pH value of from about 2 to about 10.

5. The process of claim 1, wherein the electroless plating solution comprises an electroless platable metal selected from the group consisting of copper, nickel, and silver.

6. The process of claim 1, wherein the electroless plating solution further comprises a reducing agent.

7. The process of claim 6, wherein the reducing agent is selected from the group consisting of hypophosphite, a hydrazine compound, an aldehyde compound, hydrogen borate, hydroxylamine, and a borane compound.

8. The process of claim 1, wherein the electroless plating is repeated to form a thin metallized layer comprising a first metal being silver and a second metal being selected from the group consisting of copper and nickel.

9. The process of claim 1, wherein the plating solution for electroplating comprises a platable metal selected from the group consisting of copper, nickel, and cobalt.

10. The process of claim 1, wherein the resin comprises a polymer selected from the group consisting of polyimide, an aromatic polyimide, polyether imide, polyphthalamide, and polyester.

11. The process of claim 1, wherein the thin metallized layer formed by the electroless plating has a thickness of from about 5 nanometers to about 3000 nanometers.

12. The process of claim 1, wherein the uniform metal layer has a thickness of from about 5 micrometers to about 100 micrometers.

13. A process for forming a fuser member, comprising:

providing a polyimide substrate;

treating the polyimide substrate with a polymer solution comprising a dopamine compound and an aminosilane coupling agent, to form a polydopamine layer;

immersing the treated substrate into an electroless metal plating solution to form a thin metallized layer on the polydopamine layer; and electroplating the substrate to form a uniform metal layer on the thin metallized layer.

14. The process of claim 13, wherein the uniform metal layer comprises an electroplated copper layer with a thickness of from about 5 micrometers to about 50 micrometers, and an electroplated nickel layer with a thickness of from about 5 micrometers to about 50 micrometers.

15. The process of claim 13 further including depositing, in sequence, a first adhesive layer over the uniform metal layer, an elastic layer comprised of a silicone polymer over the adhesive layer, a second adhesive layer over the elastic layer, and an outmost releasing layer comprised of a fluoropolymer over the second adhesive layer, the fluoropolymer further comprising a monomeric repeat unit that is selected from the group consisting of vinylidene fluoride, hexafluoropropylene, tetrafluoroethylene, perfluoroalkylvinylether, and mixtures thereof.

* * * * *